United States Patent [19]

Sanderson et al.

[11] 4,091,597

[45] May 30, 1978

[54] ORIENTING AND FILLING CASKS

[75] Inventors: Gordon Francis Sanderson, Hunters Hill; Anthony George Burge, Dundas, both of Australia

[73] Assignees: Automation Feeding Devices Pty Limited, Rydalmere; Tooheys Limited, Sydney, both of Australia

[21] Appl. No.: 695,082

[22] Filed: June 11, 1976

[30] Foreign Application Priority Data

June 17, 1975 Australia ..... PC2008

[51] Int. Cl.[2] ..... B65G 47/24

[52] U.S. Cl. ..... 53/59 R; 53/75; 53/281; 53/367; 141/171; 198/487; 214/1 BB; 214/340

[58] Field of Search ..... 141/171, 37, 39; 214/1 R, 1 P, 1 PB, 1 B, 1 BB, DIG. 3, DIG. 4, 1 Q, 340; 198/485–490; 53/59 R, 367, 75, 281

[56] References Cited

U.S. PATENT DOCUMENTS

| | | | |
|---|---|---|---|
| 3,033,025 | 5/1962 | McConnell et al. | 214/1 PB X |
| 3,610,398 | 10/1971 | Rice | 141/171 X |
| 3,894,637 | 7/1975 | Bickham | 214/1 P |
| 3,977,154 | 8/1976 | Kamisaka et al. | 141/171 X |

*Primary Examiner*—Frank E. Werner

[57] ABSTRACT

Cask orienting machine providing a rest station, a filling station and an intermediate orientation station for casks, advancing means to elevate the casks and advance them through the various stations and means to eject a cask in the filling station in time relation to the transfer of the following casks, means to rotate the cask in the orientation station until orientation means engages in a peripheral shive hole in the cask thereby preventing further rotation thereof. The invention also provides a cask filling and shive inserting means for an oriented cask comprising means to introduce a racking spear through the shive hole of a cask and to initiate pressurizing and filling of the cask and means to position and drive a shive into the shive hole.

11 Claims, 10 Drawing Figures

ORIENTING AND FILLING CASKS

This invention relates to the filling of casks.

Hitherto the filling of casks has at the best been a semi-mechanical operation. By means of the present invention casks having peripheral filling openings (shive holes) can be accurately oriented and filled in a fully mechanised manner.

Generally the invention provides a feeding and orienting device in combination with a liquid filling mechanism.

More specifically the invention comprises cask orienting machine providing a rest station, a filling station and an intermediate orientation station for casks, advancing means to simultaneously elevate casks in the rest and orientation stations and advance them respectively to the orientation stations and filling stations, ejection means to eject a cask in the filling station in timed relation to the transfer of the following cask from the orientation station and in advance of it arriving at the filling station and means to rotate a cask about its longitudinal axis whilst at the orientation station until orientation means engages in a peripheral shive hole in the cask thereby preventing further rotation thereof.

Figure 1:
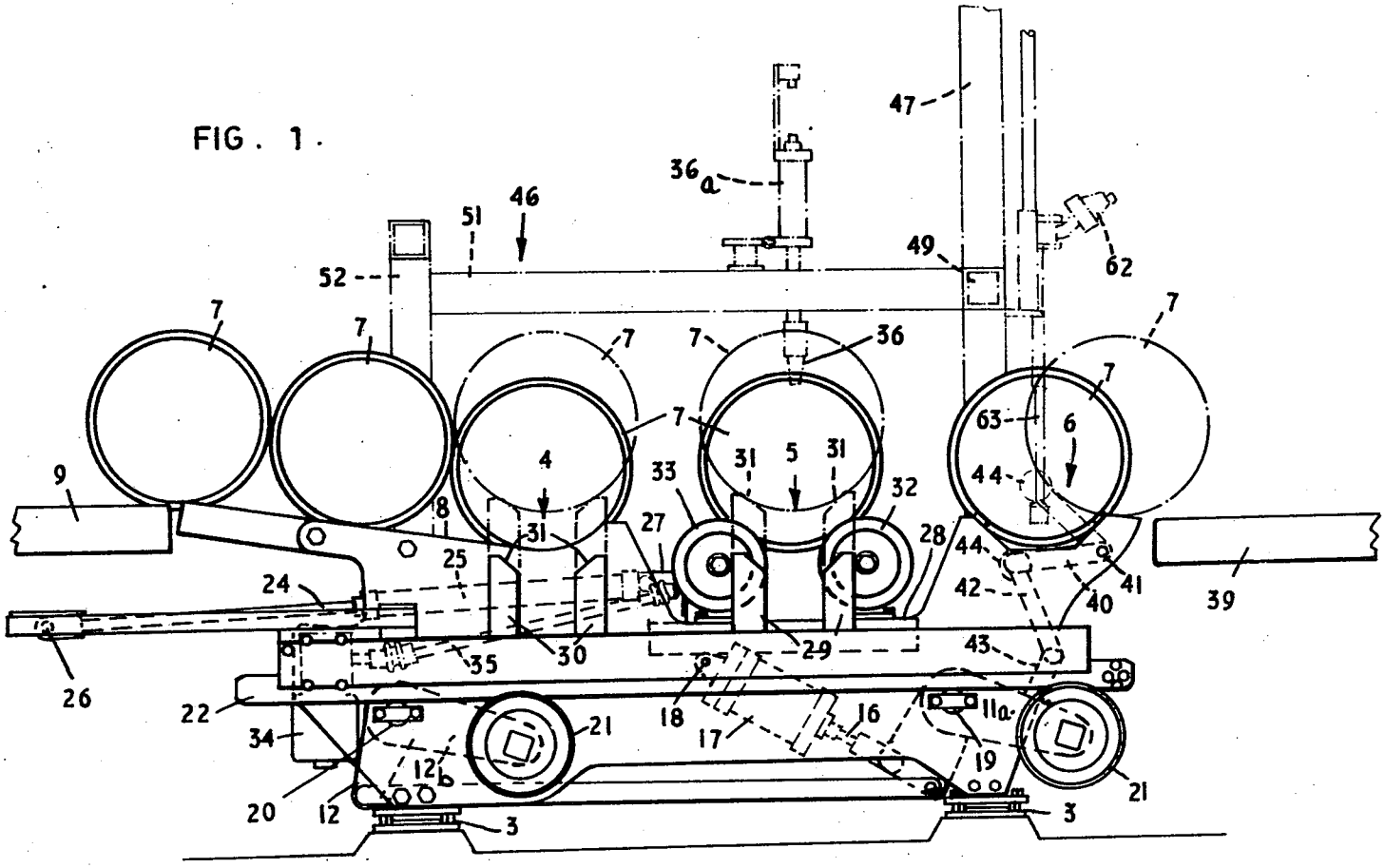
Figure 2:
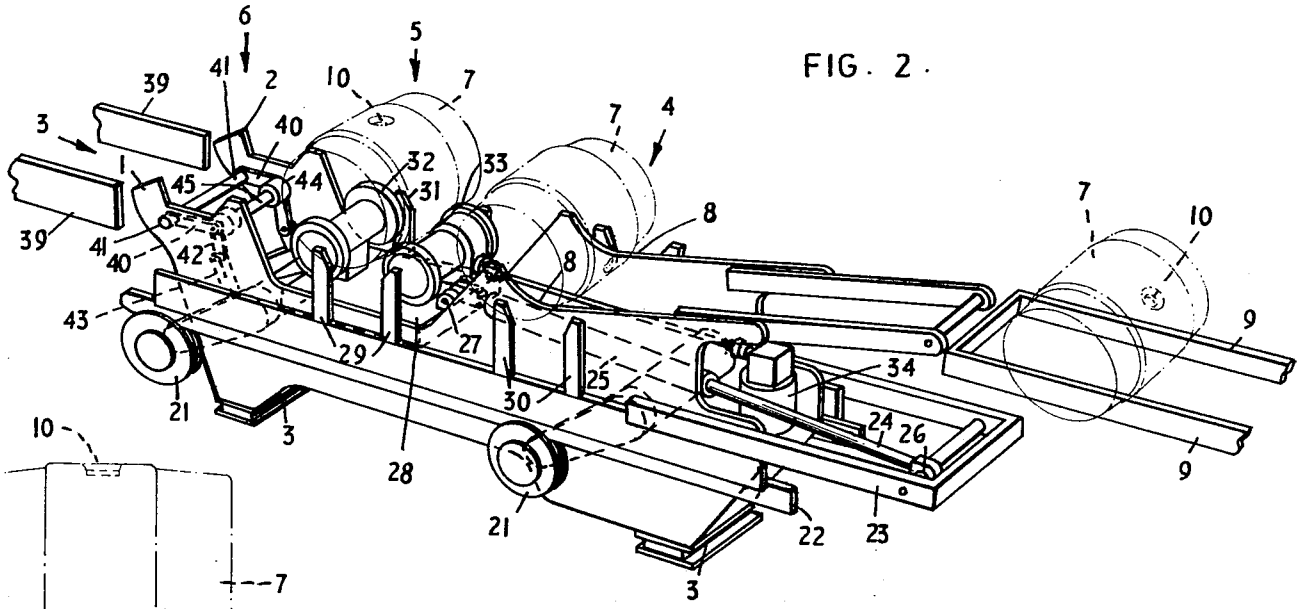
Figure 3:
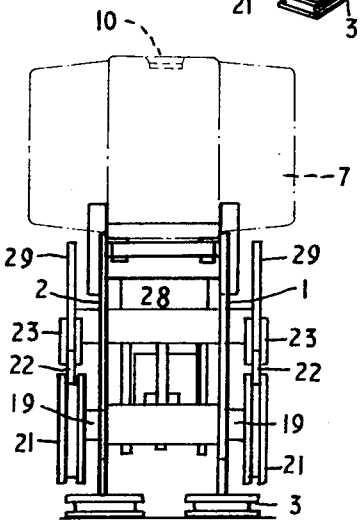
Figure 4:
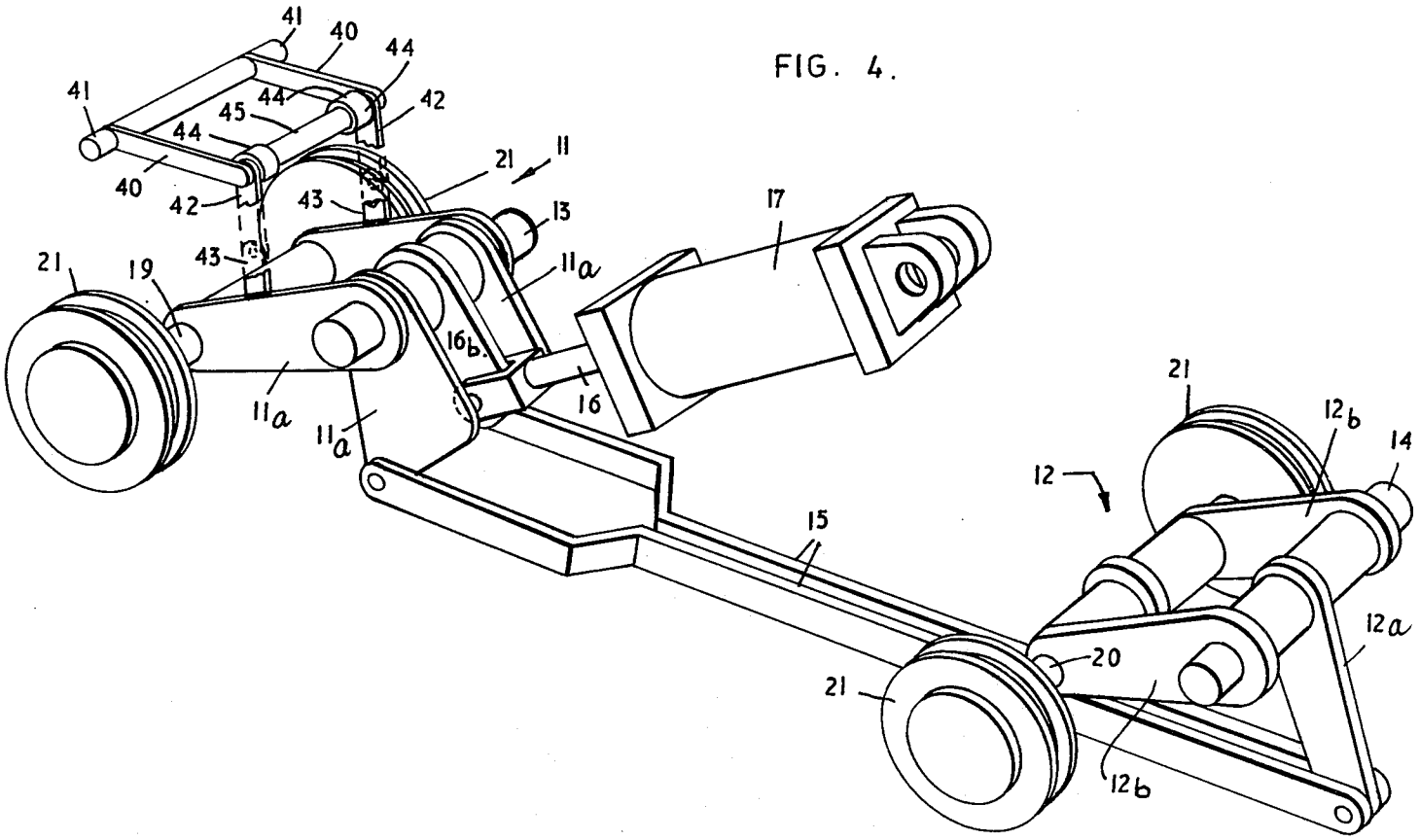
Figure 5:
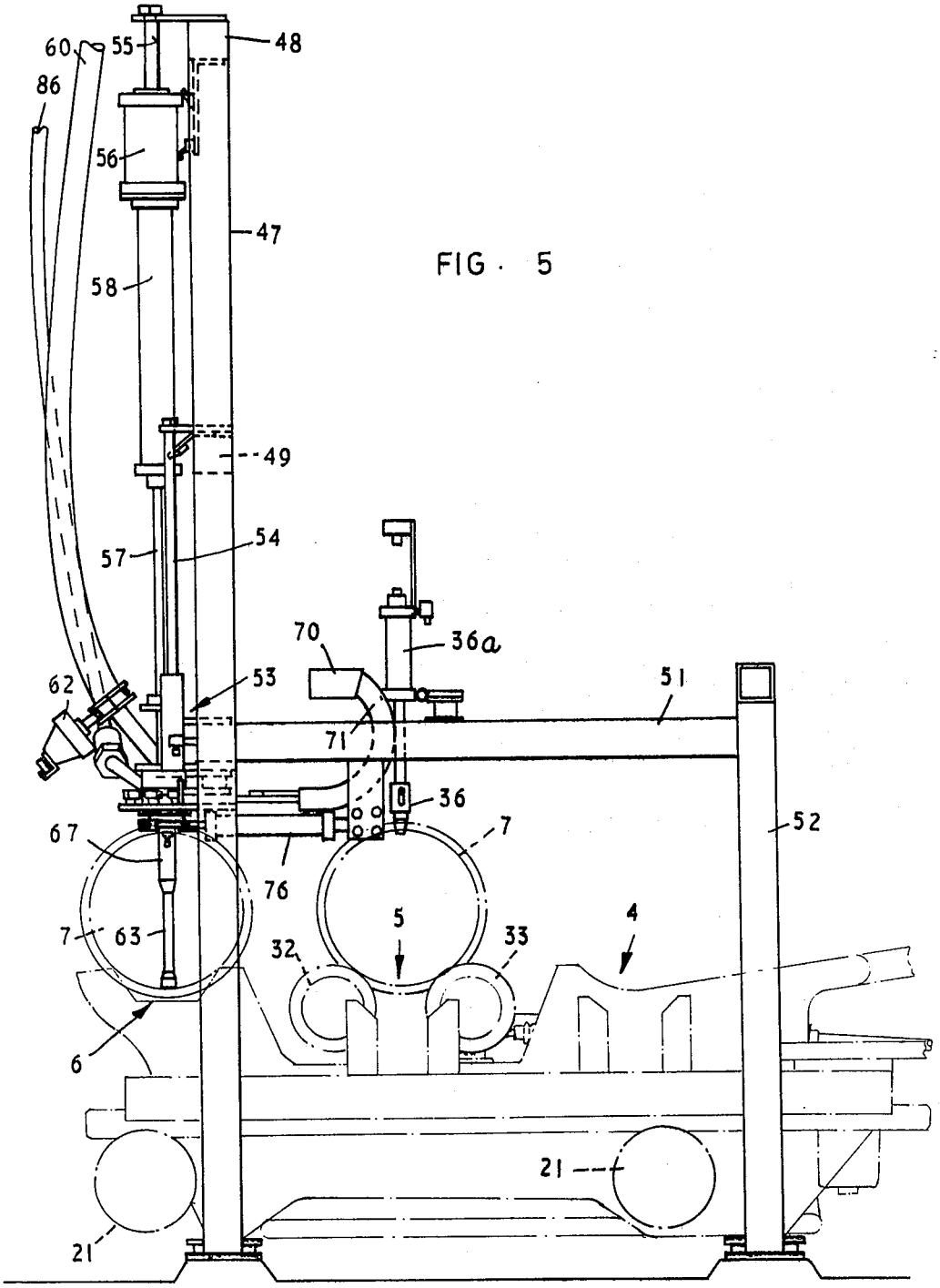
Figure 6:
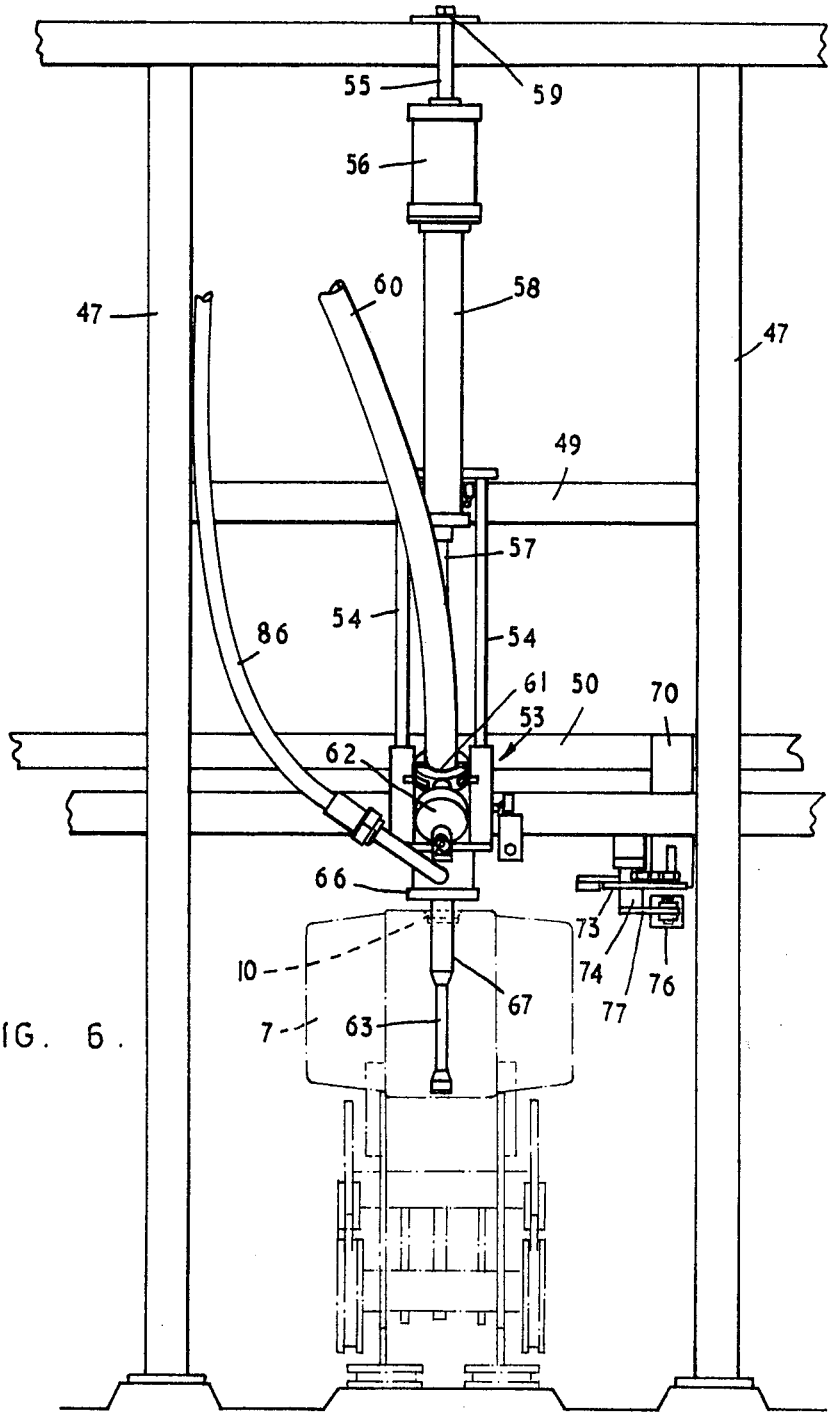
Figure 7:
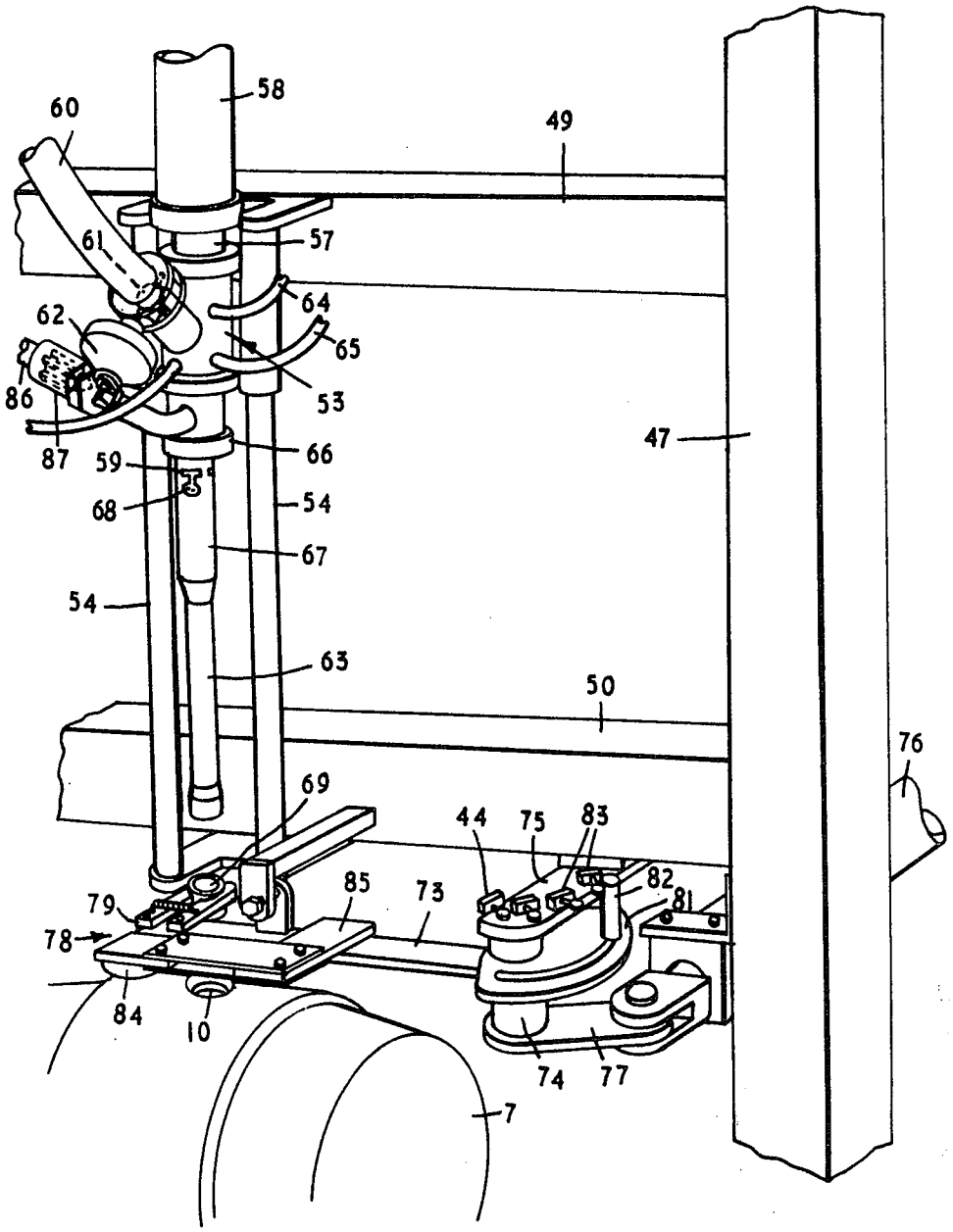
Figure 8:
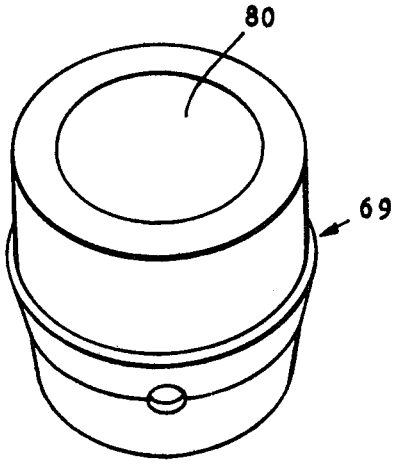
Figure 9:
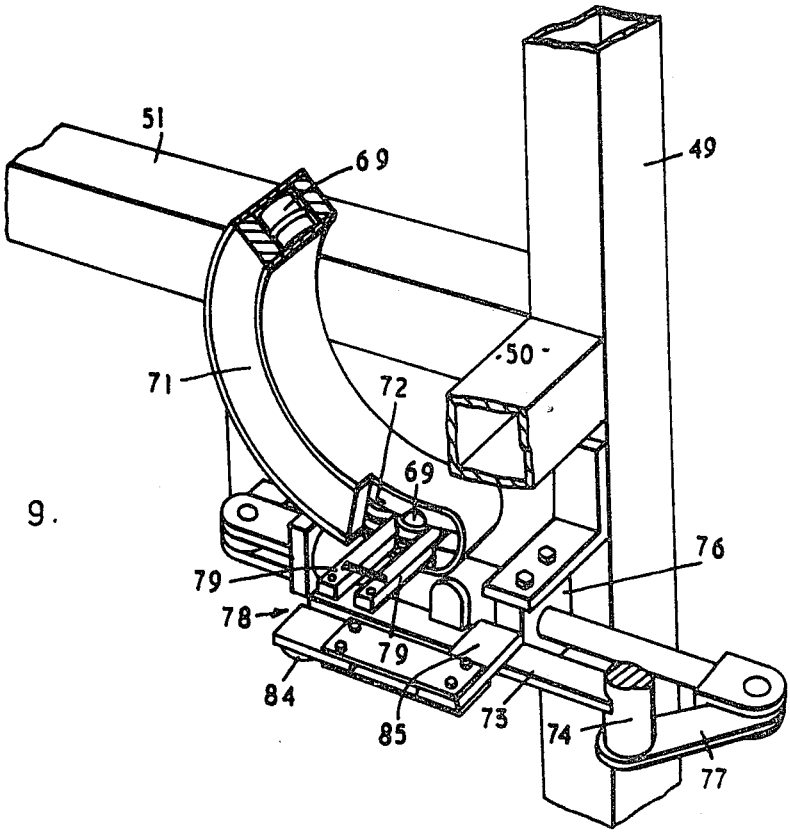
Figure 10:
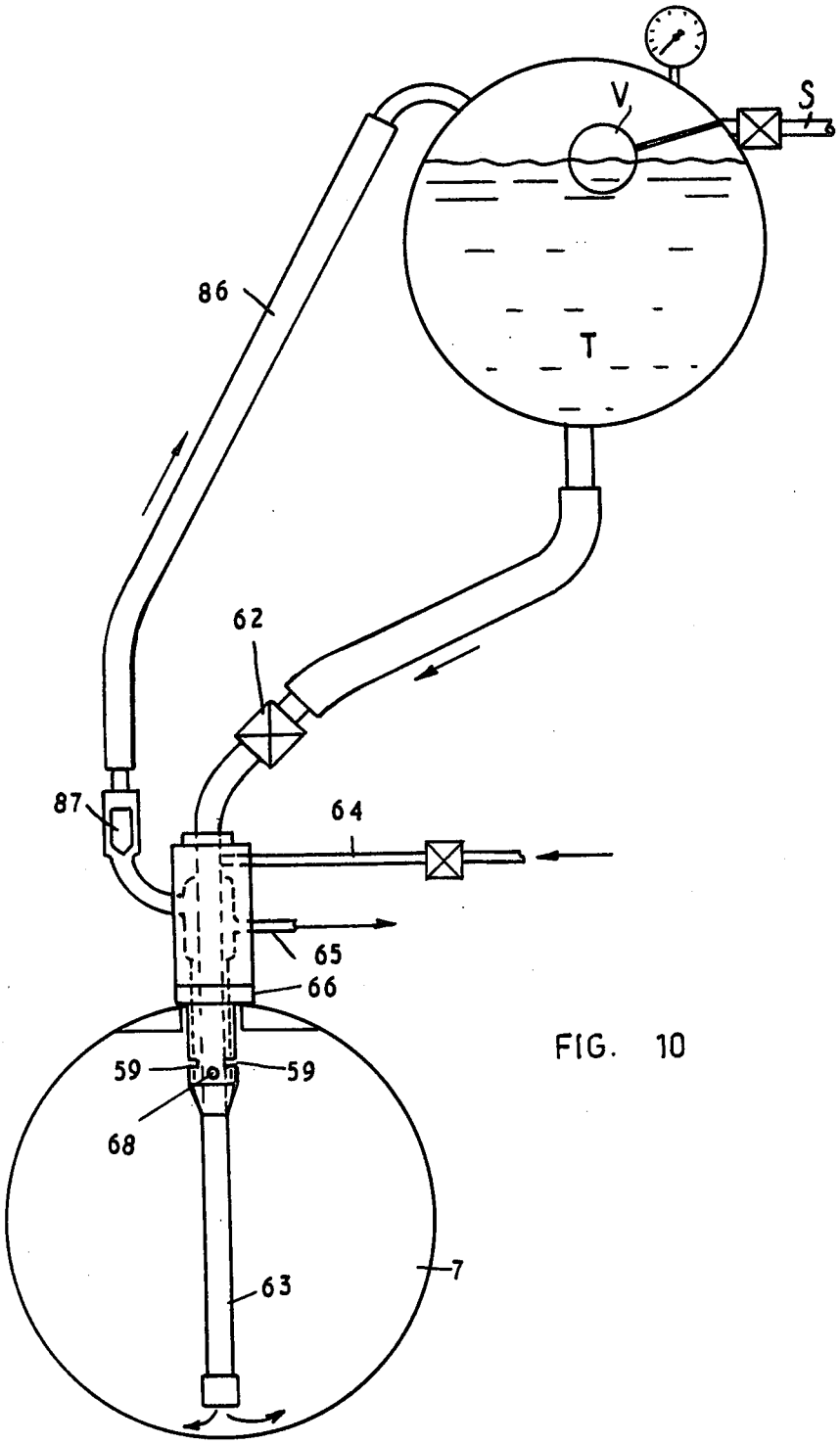

A preferred form of the invention is illustrated in the accompanying drawings in which FIG. 1 is a side elevation of the cask orienting device, FIG. 2 is a perspective view of the device shown in FIG. 1, FIG. 3 is an end elevation in the direction of arrow 3 in FIG. 2, FIG. 4 is a perspective view to an enlarged scale of the cask elevating and lowering mechanism of the device of FIG. 1, FIG. 5 is a side elevation of the cask racking means, FIG. 6 is an elevation looking in the direction of arrow 6 of FIG. 5, FIG. 7 is fragmentary front view in perspective showing a shive about to be forced into the shive hole of a filled cask, FIG. 8 is an enlarged perspective view of a shive, FIG. 9 is a fragmentary perspective view to an enlarged scale of the shive feeding mechanism, and FIG. 10 is a schematic illustration of the control circuit for the filling operation of casks.

The cask orienting device comprises a frame having two spaced parallel sides 1 and 2 which are fixed to feet 3. The upper longitudinal edges of the sides 1 and 2 are specially contoured to provide three successive stations 4, 5 and 6 for casks 7.

The sides 1 and 2 are angularly ramped at 8 to guide casks 7 to the first station 4, from a feeding conveyer 9. The function of the device is to move casks successively from station 4, to the subsequent stations 5 and 6 and also to orient each cask 7, whilst at station 5, so that the shive hole 10 thereof is located at the top of the cask as shown in FIG. 2. To achieve this a mechanism is provided which comprises bell cranks 11 and 12 respectively fixed to horizontal shafts 13 and 14 (see FIG. 4) journalled in the sides 1 and 2. The bell cranks 11 each comprises a pair of arms **11*a* fixed together and the bell crank 12 comprises a single arm 12*a* fixed to two arms 12*b*. The bell crank 11 is pivotally connected by link bars 15 to the bell crank 12. A pneumatic piston and cylinder assembly 16–17 is positioned between the sides 1 and 2, with the cylinder 17 pivotally connected as at 18 to the frame and the piston rod 16 pivotally connected to arm 16*a* fixed to shaft 13. When the assembly 16–17 is actuated the shaft 13 with the bell cranks 11 and arm 16*a* move arcuately and through the links 15 the bell crank 12, fixed to shaft 14 is also moved arcuately. Shafts 19 and 20 fixed to bell cranks 11 and 12 respectively, are thus raised or lowered along with grooved wheels 21 on the shafts 19–20. The wheels 21 engage runner bars 22 which rest at all times in the grooves of wheels 21. The bars 22 are secured to a yoke member 23 which can be displaced horizontally with the bars 22 by means of a pneumatic piston and cylinder assembly 24–25 respectively secured at one end 26 to the yoke 23, and at the other end 27 to a stationary horizontal table 28 mounted between the sides 1 and 2**.

Pairs of arms 29 and 30 are secured to the yoke 23 so that the arms extend vertically upwards. The arms 29–30 have angled ends 31 to provide a notch to centrally support casks 7. In operation a cask 7 (see FIG. 2) is located at station 4, when the assembly 16–17 is extended, the yoke 23 and arms 29–30 are raised bodily so that the cask 7 is lifted clear of the ramped portion 8 of the sides 1 and 2. The assembly 24–25 is contracted so that the yoke 23 and arms 30 with the supported cask 7 are moved to station 5. The cask at station 5 is then lowered by contraction of assembly 16–17 so that the cask 7 rests on pairs of rollers 32 and 33 rotatably mounted on the table 28. The rollers 33 are driven by a motor 34 by means of a drive shaft 35 so that the cask thereon will be rotated about its longitudinal axis.

A weighted conical headed plunger 36 in end ways alignment with the shive hole (see FIG. 1) slidably housed in a cylinder **36*a* is pivotally connected to a frame 46 and engages the periphery of the rotating cask. The cask continues to rotate until the shive hole 10 is at the uppermost position where the plunger head drops into the hole 10 with the conical head accurately orienting the shive hole. The cask is thus prevented from rotating further and slippage occurs between the cask and rollers 33**.

As the cask is being positioned and the shive hole engaged by the plunger head the yoke has returned to its starting position by extension of assembly 24–25, so that the arms 29 are now below the cask on the rollers 32–33. Assembly 16–17 is now extended so that the arms 29 raise the cask at station 5 clear of the rollers 32 and 33. At the same time the plunger 36 is raised clear by the cylinder 37 (see FIG. 1). The cask is now moved horizontally to station 6 by contraction of assembly 24–25 whilst at the same time a new cask is delivered from station 4 to station 5 as previously described.

The cask from station 6 (where filling takes place) is transferred onto a conveyor 39 at the same time as the cask from station 5 advances. The transfer is achieved by ejector arms 40 fixed to shaft 41 pivotally mounted in the sides 1 and 2. Link arms 42 connect the ejector arms 40 to lugs 43 fixed to the bell crank arms **11*a*. When the assembly 16–17 is extended ejector arms 40 are raised so that rollers 44, on shaft 45 connecting the ends of the link arms 42 and the ejector arms 40, engage the under side of the cask at station 6 and displace it onto the conveyor 39**.

The racking means receives casks 7 which have been oriented at station 5 so the shive hole 10 is uppermost, the orienting means is shown in dotted outline in FIG. 6. The racking means is mounted on the frame 46 which straddles station 6 and comprises vertical columns 47 joined by horizontal beams 48, 49 and 50 with beams 51 connecting the columns 47 to rear shorter columns 52.

A filling head 53 (FIG. 7) is slidably mounted on guide bars 54 secured to and extending between the beams 49 and 50. The filling head 53 is vertically movable by two pneumatic piston and cylinder units 55-56 and 57-58. The free end of the piston shaft 55 of the more powerful cylinder 56 is secured at 59 to the beam 48. The two cylinders 56 and 58 are axially secured together in tandem with the free end of the plunger shaft 57 secured to the filling head 53.

A plenum chamber is located within the filling head 53. Liquid, for example beer, is fed from a storage tank (see FIG. 10) via a pipe 60, to a hollow racking spear 63 passing through the plenum chamber. The flow is controlled by a butterfly valve 61 governed by a pneumatic actuator 62.

A compressed air supply line 64 discharges into the spear 63. A sensor tube 65 extends from the plenum chamber to a pneumatic control means (see FIG. 10). As a result of orientation the cask at position 6 has its shive hole 10 axially aligned with the spear 63. The cylinder 58 is then powered to lower the spear 63 into the cask through the hole 10 and a collar 66 on an upper larger diameter section 67 of the spear 63 makes liquid tight seal with the cask around the shive hole 10. Compressed air is now admitted to the cask 7 via the line 64 until the pressure in the cask equals a predetermined amount sufficient to raise a oneway valve 87 off its seat to allow air to pass through line 86 into a pressurized header tank of liquid to be filled into the cask. The butterfly valve 61 is opened as a result of this condition being conveyed through sensor tube 65 to the control means, air to the tube 65 extering the plenum chamber through ports 59. The beer then fills the cask from the header tank by gravity flow within the pressurized system.

When the cask is full the liquid bridges two electric contacts 68 in the portion 67 of the spear 63 and the valve 61 is closed. The cylinder 58 is actuated to withdraw the spear 63. The sequence is controlled from the control means in the manner hereinafter described.

The cask is now sealed by a shive 69 fed from a conveyor 70 through a curved feeding chute 71 to a discharge opening 72 at the bottom of said chute 71.

A shive delivery mechanism transfers shives one at a time to a position where they are forced into the cask shive hole. The mechanism comprises a radial arm 73 pivotally secured to a shaft 74 journalled in a bracket 75 secured to the beam 50. A pneumatic cylinder 76 anchored to beam 51, is adapted on retraction to rotate the shaft 74 via a crank arm 77 so that the arm 73 will move from a position where its free end 78 lies adjacent the shive feed chute 71 (as shown in FIG. 9) to a position below the spear 63 (as shown in FIG. 7).

Two spring loaded fingers 79 on the end 78 of arm 73 peripherally grip the shive 69. The cylinder 56 is now actuated so that the spear 63 descends to engage the shive 69. The spear 63 enters a depression 80 in the top of the shive 69 to dislodge it from the fingers 79 and force into the shive hole 10. It will be noted that the stroke of the cylinder 56 is considerably less than that of the cylinder 58.

A quadrant plate 81 is also secured to the shaft 74 and a pin 82 on the plate 81 wipes over and actuates pneumatic valves 83 fixed to bracket 75. These valves govern the movement of the arm 73, i.e. operation of unit 76. When the shive 69 has been entered into the shive hole 10 the spear 63 is raised leaving the shive in place. The arm 73 is now moved through a small return angle governed by the valve mechanism 83 so that a spring mounted anvil plate 84, secured to the arm 73 by a bracket 85, is positioned above the shive 69 in the shive hole 10. The spear 63 is now lowered again by the cylinder 56 so that the spear 63 bears on the anvil plate 84 which in turn bears on the shive 69 to drive the shive home level with the cask periphery.

The filled sealed cask is now cleared from its position below the racking means, by the mechanism incorporating ejector arms 40 previously described.

FIG. 10 schematically showing the mode of operation of the filling controls will now be described. In FIG. 10 the pressurized bulk liquid tank is marked T. The liquid feed line and counter pressure 60 and 86 respectively are indicated. The other various components such as the air inlet and outlet lines 64 and 65 and racking spear 63 can also be seen.

The tank T is maintained at a correct filled level by a supply through supply line s controlled by a float control valve *v*. This diagram when read in conjunction with the previous description clearly shows the operation of the arrangement. The actual controls and means for sequencing the operation of various components is not considered in itself to be inventive and may be achieved in any suitable manner using known pneumatic technology.

We claim:

1. A cask orienting, filling and shive inserting machine, said machine having a rest station, a filling station and an intermediate orientation station for casks; advancing means to simultaneously elevate casks in the rest and orientation stations and advance them respectively to the orientation and filling stations; ejection means to eject a cask in the filling station in timed relation to the transfer of the following cask from the orientation station and in advance of said following cask arriving at the filling station; an orientation means; means to rotate the cask about its longitudinal axis while at the orientation station until said orientation means engages in a peripheral shive hole in the cask thereby preventing further rotation thereof, a cask filling and shive inserting means for the oriented cask located at the filling station, said cask filling and shive inserting means comprising a racking spear; an extensible and contractable assembly to introduce the spear through the shive hole of the oriented cask at the filling station; sealing means on the spear to sealingly engage the exterior of the cask around the shive hole; gas delivery means on the racking spear to pass compressed gas therethrough; liquid delivery means on the racking spear to pass liquid therethrough; first detector means on the racking spear to detect gas pressure in a cask to be filled with liquid; second detector means on the racking spear to detect liquid level in a cask being filled; pressure equalising means to open at a predetermined pressure to connect the pressurized interior of the cask with a pressurized header tank of liquid connected to the liquid delivery means and to close when the pressure in the cask drops below said predetermined pressure; first valve means to regulate the flow of liquid the opening of which is controlled by the first detector means and the closing of which is controlled by the second detector means; second valve means to shut off the flow of gas to the cask controlled by the first detector means; the first control means incorporating said first and second detector means being operable to actuate said extensible and contractable assembly to lower said racking spear into the cask and to engage the sealing means on the cask to admit gas to the cask and said assembly being operable after filling of the cask to withdraw the spear by contraction of said extensible and contractable assembly; and shive storing and delivery means to store and then position one shive for each cask that has been filled over the shive hole of that cask in timed relation to the withdrawal of the racking spear, and means to control the re-extension of the extensible and contractable assembly to engage the racking spear with the shive and to force the shive into the shive hole of the filled cask.

2. The machine as claimed in claim 1, wherein there are provided spaced side frames with contours on the frames to support the casks adjacent their ends when in the rest and filling stations, a pair of rollers to cradle the cask in the orientation station, drive means to rotate the rollers, a table movable longitudinally of the side frames, means to move the table longitudinally, means to raise the table and support it during longitudinal movement and to lower the table, support means on the table to engage the casks in the rest and orientation stations as the table is raised and to support those casks while the table moves longitudinally to transport the casks to the orientation and filling stations respectively and until they are deposited in the filling and orientation stations by lowering movement of the table.

3. The machine as claimed in claim 2 wherein the means to eject the cask from the filling station includes raisable ejection arms to engage under and dislodge a cask from the filling station as the table is raised.

4. The machine as claimed in claim 2 wherein the orientation means is a plunger which peripherally rides on the cask as it rotates in alignment with the cask shive hole until the plunger engages in the shive hole, and means to raise the plunger out of the shive hole once the cask is raised clear of said rollers in the operation of moving the cask from the orientation station to the filling station.

5. The machine as claimed in claim 2 wherein the means to raise and lower the table comprises a piston and cylinder assembly respectively end connected to the side frames and to one arm of a first bell crank means fulcrummed on the side frames, link means coupling the said one arm to one arm of a second bell crank means fulcrummed on the side frames, and pulleys on the other arms of both bell crank means on which said table is supported at all times.

6. The machine as claimed in claim 5 wherein the means to longitudinally move the table is a piston and cylinder assembly respectively end connected to the table and to the side frames.

7. The machine as claimed in claim 5 wherein the raisable ejection arms are linked to the other arm of the first bell crank means so as to be raised to eject a cask from the filling station when the table is raised.

8. The machine claimed in claim 1 wherein the extensible and contractable assembly comprises a first piston and cylinder combination to insert and withdraw the racking spear in the liquid filling operation and a second piston and cylinder combination in axial tandem arrangement with the first piston and cylinder assembly for inserting the shive in the shive hole of a cask; said shive delivery means comprising a shive magazine, a delivery arm, a shive holder on the delivery arm, actuating means to move the arm to a first position to cause engagement of the shive holder with a shive in the magazine and to a second position where the shive is located over the shive hole of a cask and to a third position where an anvil plate on the delivery arm overlies the shive hole of a cask; said first control means also controlling the actuating means in timed relation to the removal of the racking spear to sequentially locate the delivery arm in the second position and to extend the second of said tandem piston and cylinder assemblies to remove the shive from the fingers and to partially insert it into the shive hole and to withdraw the racking spear by contraction of the second tandem piston and cylinder assembly and to move the delivery arm to the third location and to extend the second tandem piston and cylinder assembly a second time to engage the anvil and exert pressure on the anvil to push the shive fully into the shive hole.

9. A cask orienting, filling and shive inserting machine comprising an elongated main frame, a first cask support means fixed to and located adjacent one end of the main frame, a second cask support means fixed to and located adjacent the other end of the main frame, a third cask support means positioned half way between the first and second cask support means on the main frame, said third cask support means comprising a pair of continuously driven spaced apart rollers mounted on the main frame with axes of location transverse to the main frame; an elongated sub-frame; side rails at the long sides of the sub-frame, two spaced apart cask supports on the sub-frame with the spacing being equal to the spacing between the first and third cask support means of the main frame; a first piston and cylinder combination linking the sub-frame to the main frame to move the sub-frame from a first position where the cask supports thereon are respectively aligned with the first and third cask support means of the main frame to a second position where said last-mentioned cask supports are aligned with the second and third cask support means of the main frame and to then return the sub-frame to the first position; four wheel arms pivotally mounted on the main frame and a wheel on each wheel arm; a linkage connecting the wheel arms; a second piston and cylinder combination connecting the linkage to the main frame to move the wheels into engagement with the rails of the sub-frame and to raise the sub-frame in timed relationship with the operation of the first piston and cylinder combination so that casks on the cask support means of the main frame are raised clear of the supports on the sub-frame prior to the movement of the sub-frame by the first piston and cylinder combination; cask bung hole orientation means located over the third support so as to be in the path of the cask bung hole as the cask is rotated by the third cask support means and to engage in said bung hole to prevent continued rotation of the cask, means to raise and lower said orientation means; a cask ejector comprising ejector arms pivotally connected to the main frame, links connecting said ejector arms to the wheel arms so as to move synchronously therewith to eject any cask located on the second cask support means of the main frame each time the wheel arms are moved by the second piston and cylinder combination; a cask filling and shive inserting means for the oriented cask located at the filling station; said cask filling and shive inserting means comprising a racking spear, an extensible and contractable assembly to introduce the spear through the shive hole of the oriented cask at the filling station, sealing means on the spear to sealingly engage the exterior of the cask around the shive hole, gas delivery means on the racking spear to pass compressed gas therethrough, liquid delivery means on the racking spear to pass liquid therethrough, first detector means on the racking spear to detect gas pressure in a cask to be filled with liquid, second detector means on the racking spear to detect liquid level in a cask being filled, pressure equalizing means to open at a predetermined pressure to connect the pressurized interior of the cask with a pressurized header tank of liquid connected to the liquid delivery means and to close when the pressure in the cask drops below said predetermined pressure, first valve means to regulate the flow of liquid, the opening of said first valve means being controlled by the first detector means and the closing of said first valve means being controlled by the second detector means, second valve means to shut off the flow of gas to the cask controlled by the first detector means, the first control means incorporating said first and second detector means being operable to actuate said extensible and contractable assembly to lower said racking spear into the cask and to engage the sealing means on the cask to admit gas to the cask and said assembly being operable after filling of the cask to withdraw the spear by contraction of said extensible and contractable assembly; and shive storing and delivery means to store and then position one shive for each cask that has been filled over the shive hole of that cask in timed relation to the withdrawal of the racking spear, and means to control the re-extension of the extensible and contractable assembly to engage the racking spear with the shive and to force the shive into the shive hole of the filled cask.

10. The machine claimed in claim 9, wherein the orientation means is a conical plunger lead to engage the cask bung hole, a plunger fixed to the plunger lead, a piston on the plunger and a cylinder housing the piston and pivotally mounted on an axis parallel to said roller axes.

11. The machine as claimed in claim 9 wherein said four wheel arms are arranged in pairs with each pair comprising a portion of a bell crank, two shafts pivotally mounted in the main frame parallel to the roller axes, a bell crank fixed to each shaft, said linkage connecting the bell cranks, a lower arm fixed to one shaft, said first piston and cylinder combination connecting said power arm to said main frame.

* * * * *